United States Patent [19]

Bay

[11] Patent Number: 4,613,796

[45] Date of Patent: Sep. 23, 1986

[54] SINGLE TRANSISTOR OSCILLATOR BALLAST CIRCUIT

[75] Inventor: David L. Bay, Beverly, Mass.

[73] Assignee: GTE Products Corporation, Stamford, Conn.

[21] Appl. No.: 639,764

[22] Filed: Aug. 13, 1984

[51] Int. Cl.[4] ..... H05B 37/02

[52] U.S. Cl. ..... 315/219; 315/206; 315/208; 331/113 A

[58] Field of Search ..... 331/113 A; 315/206, 315/208, 219

[56] References Cited

U.S. PATENT DOCUMENTS 4,005,335 1/1977 Perper ..... 331/113 A 4,254,362 3/1981 Tulleners ..... 315/219

4,261,025 4/1981 Chafer et al. ..... 331/113 A 4,547,705 10/1985 Hirayama ..... 315/219

*Primary Examiner*—Harold Dixon

*Attorney, Agent, or Firm*—Thomas H. Buffton; Carlo S. Bessone

[57] ABSTRACT

A single power transistor oscillator circuit includes a single transistor oscillator coupled by an inductive means including an inductive coil and transformer to a DC potential development means with a wave-shaping means coupled to a secondary winding of the transformer to provide a substantially symmetrical AC potential centered about a zero level DC voltage and applied to a load circuit.

13 Claims, 1 Drawing Figure

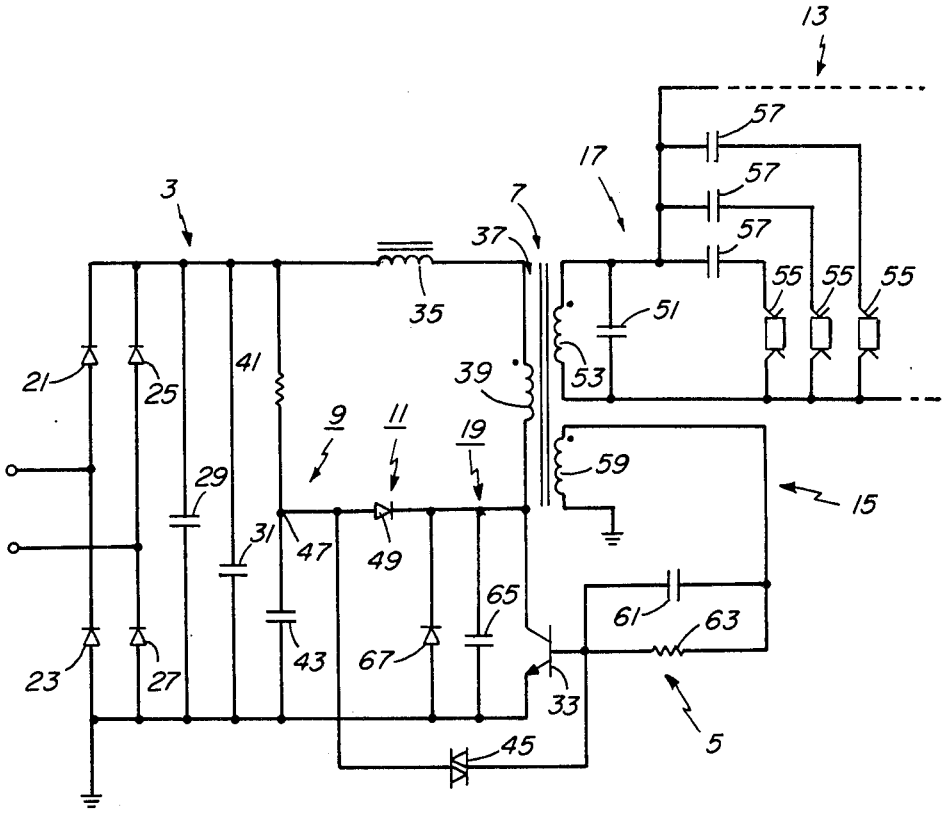
13
57
57
57
17
3
7
37
35
55
55
55
51
21
25
41
39
53
9
11
19
59
29
15
31
47
49
65
61
63
43
67
23
27
33
5
45

SINGLE TRANSISTOR OSCILLATOR BALLAST CIRCUIT

TECHNICAL FIELD

This invention relates to single transistor oscillator circuits and more particularly to single power transistor oscillator and ballast circuits especially suitable for driving fluorescent lamps and manufacturable in a solid state configuration.

BACKGROUND ART

The traditional technique for energizing fluorescent lamps employs a relatively inefficient autotransformer operable at a 60-Hz rate. The transformer is purposefully designed to be inefficient in order to act as a current limiter or ballast circuit whereby excessive current flow is prevented. Obviously, such energy waste and excessive heat generation is undesirable and heavy and expensive autotransformers leave much to be desired.

Recent efforts have focused upon the design of solid state ballasts for driving fluorescent lamps at relatively high frequencies, such as about 20 KHz for example. Such circuitry not only tends to reduce the weight and size of the ballasting operation but also increases the efficiency and predictability of performance while virtually eliminating noise within the audible range.

However, the known ballast circuitry suitable for solid state designs is, for the most part, of a multiple semiconductor design and includes multiple power transistor elements. Unfortunately, multiple power transistor elements present difficulties when integrated designs are attempted due to the multiple potentials required by the individual semiconductor elements. In other words, supplying a multitude of different voltages to semiconductors on a single integrated substrate presents numerous problems in manufacture, cost, efficiency and performance.

Additionally, the known circuitry employing a single transistor does not provide an output potential suitable for use with fluorescent lamps. More specifically, the known forms of single power transistor oscillator circuitry generate an asymmetric output potential including a DC component. Unfortunately, it is not desirable to operate fluorescent lamps with a potential that includes a DC component due to the tendency toward so-called "mercury migration" wherein a linear fluorescent lamp tends to exhibit an undesired differential in light output from one end to the other when the operational potential includes a DC component.

OBJECTS AND SUMMARY OF THE INVENTION

An object of the present invention is to provide ballast circuitry which overcomes the above-mentioned dificiencies of the prior art. Another object of the invention is to provide an enhanced single transistor oscillator circuit suitable for use with fluorescent lamps. Still another object of the invention is to enhance the operation of ballast circuitry for fluorescent lamps. A further object of the invention is to reduce the component cost and improve the feasibility of an integrated single transistor ballast circuit for fluorescent lamps.

These and other objects, advantages and capabilities are achieved in one aspect of the invention by a single transistor oscillator operable from a DC potential source and including an inductor means coupling the DC potential source to the oscillator and to a load with a potential wave-shaping means shunting the inductor means coupled to the load.

BRIEF DESCRIPTION OF THE DRAWINGS

The sole FIGURE is a single transistor ballast circuit suitable to the operation of fluorescent lamps.

BEST MODE FOR CARRYING OUT THE INVENTION

For a better understanding of the present invention, together with other and further objects, advantages and capabilities thereof, reference is made to the following disclosure and appended claims in connection with the accompanying drawing.

Referring to the drawing, a single transistor oscillator circuit suitable for integration and operable with low pressure discharge lamps, such as fluorescent lamps, includes a pulsating DC potential source development means 3 connectable to an AC potential source. A single transistor oscillator 5 is coupled to the DC potential source development means 3 by an inductive means 7 and a starting circuit 9 shunts the DC potential source development means 3 and is coupled to the oscillator 5. A starting circuit disablement means 11 is also coupled to the starting circuit 9 and to the oscillator 5. Moreover, a load circuit 13 and a feedback network 15 are coupled to the inductive means 7. Importantly, a first wave-shaping means 17 is coupled to the inductive means 7 and load circuit 13 and a second wave-shaping means 19 is coupled to the oscillator 5.

More specifically, a DC potential source development means 3 is in the form of a full-wave rectifier having a plurality of diodes, 21, 23, 25 and 27 and filtering capacitors 29 and 31 respectively. An oscillator 5, in the form of a single transistor 33 includes the usual collector, emitter and base electrodes and is coupled to the DC potential source development means or full-wave rectifier 3 by the inductive means 7. This inductive means 7 includes an inductor or ballast coil 35 and a transformer 37 with the primary winding 39 of the transformer 37 in series connection with the coil 35 intermediate the DC potential source 3 and the transistor 33.

Also, a starting circuit 9 for the oscillator 5 includes a series connected resistor 41 and capacitor 43 shunting the DC potential source development means or full-wave rectifier 3 and a diac or bi-directionally conductive semiconductor 45 coupling the junction 47 of the series connected resistor 41 and capacitor 43 to a base electrode of the transistor 33. Further, the starting circuit disablement means 11 is illustrated in the form of a diode 49 coupling the junction 47 of the resistor 41 and capacitor 43 of the starting circuit means 9 to the junction of the collector electrode of the transistor 33 and the primary winding 39 of the transformer 37 of the inductive means 7.

A first wave-shaping means 17 includes a capacitor 51 shunting a first secondary winding 53 of the transformer 37 of the inductive means 7. A load circuit 13 preferably includes one or more fluorescent lamps 55 each of which is in series connection with a load capacitor 57 and shunted across the first secondary winding 53 and capacitor 51 of the first wave-shaping means 17. Also, a feedback network 15 includes a second secondary winding 59 of the transformer 37 coupled to the primary winding 39 and by way of a parallel connected capacitor 61 and resistor 63 to the base electrode of the transistor 33 of the oscillator means 5.

Additionally, a second wave-shaping or potential-shaping means in the form of a capacitor 65 is shunted across the collector and emitter electrodes of the transistor 33 of the oscillator means 5. Moreover, an inverse voltage protection means in the form of a diode 67 is also shunted across the collector-emitter electrodes of the transistor 33 of the oscillator 5.

As to operation, an AC input voltage is rectified by the full-wave rectifier or DC potential source development means 3 including the filtering capacitor 29 and provides a slightly modulated or pulsating DC potential. This DC potential is applied to a series connected resistor 41 and capacitor 43. When the capacitor 43 attains a change which exceeds the break-over or conductivity point of the diac 45, this potential is applied to the base electrode of the transistor 33 of the oscillator means 5. Thereupon, the transistor 33 is forward biased which turns on the transistor 33 establishing collector current.

Conductivity of the transistor 33 of the oscillator means 5 drives a collector electrode load which is primarily inductive resulting in a collector current wave-shape which is essentially a ramp having a slope defined by the inductance of the collector electrode load (L) and the voltage (v) across the collector electrode load i.e., $di/dt = V/L$. This inductance of the collector electrode load is essentially a combination of the inductance of the inductor coil 35, the leakage inductance of the transformer 37 and the inductance as seen looking into the primary winding 39 of the transformer 37.

Importantly, the first potential shaping means 17 includes a first secondary winding 53 plus the secondary leakage of the transformers 37 in series connection and in parallel sinewave resonance with the capacitor 51 at some given frequency F1. Therefore, the voltage developed across the first secondary winding 53 of the transformer 37 will be in the form of a shaped sine wave. Also, the voltage induced across the primary winding 39 of the transformer 37 because of the coupling of the primary winding 39 and secondary winding 53 will be in the form of a shaped sine wave at the given frequency F1. Moreover, the voltage appearing across the second secondary winding 59 of the transformer 37 and providing a positive feedback base drive for the transistor 33 will also be in the form of a shaped sine wave having a substantially zero DC reference level.

Accordingly, as the voltage across the primary winding 39 of the transformer 37 approaches zero with a negative-going slope, the transistor 33 will be turned off because the positive feedback voltage at the base electrode of the transistor 33 will become insufficient to forward bias the base-emitter junction of the transistor 33. Since the collector current of the transistor 33 will begin to slope from its peak volume toward zero upon cessation of the base drive to the transistor 33, the collector-emitter voltage of the transistor 33 will tend to slope positively toward some peak value. This peak value of collector-emitter voltage could be of a value sufficient to be deleterious to the transistor 33. However, the so-called "snubber" network, in the form of a shaping network comprised of the capacitor 65 and the collector-connected inductances, 39 and 35 respectively, will shape the collector-emitter voltage of the transistor 33 in a manner to inhibit the appearance of excessive voltage across the transistor 33. Therefore, deleterious effects upon the transistor 33 due to excessive voltages are negated.

Additionally, the second wave-shaping means in the form of a capacitor 65 is connected in parallel with or across the collector-emitter electrodes of the transistor oscillator 33. It can be seen that the capacitor 65 will become charged as the transistor 33 is turned off. Also, the capacitor 65 is chosen to be of a value such that the inductance value of the inductor coil 35 is in series resonance therewith at a frequency of approximately twice the given frequency F1. Further, the fact that the impedance looking into the primary winding 39 is substantially a short circuit at frequencies of about twice the given frequency F1 causes the voltage across the primary winding 39 and across the first secondary winding 53 of the transformer 37 to remain substantially unaffected by the current through the primary winding 39 at approximately twice the given frequency F1. Thus, the negative excursion of the voltage across the primary winding 39 will be resonantly shaped at the given frequency F1 due to the storage of resonant energy in the transformer 37 upon cessation of the collector current of the transistor 33. Meanwhile, the collector-emitter voltage of the transistor 33 is being shaped by the charging capacitor 65. Moreover, as the voltage of the first secondary winding 53 approaches zero with a positive slope, the resonant condition of the transformer 37 and its load will induce the voltage across the feedback or second secondary winding 59 to cross back through zero voltage and attain a positive magnitude sufficient to forward bias the base-emitter of the transistor 33 and to turn on the transistor 33 and repeat the cycle again at the given frequency F1.

Thus, the voltage appearing across the wave-shaping means 17 in the form of the capacitor 51 will be a substantially symmetrical-shaped sine wave at the given frequency F1 and centered about a substantially zero DC voltage level. In the meantime, each of the fluorescent lamps 55 is ballasted off the voltage across the capacitor 51 and independently ballasted by a capacitor 57.

Finally, the starting circuit disablement means 11 in the form of the diode 49 is connected to the collector electrode of the transistor 33 with the anode of the diode 49 connected to the starting circuit 9. As soon as the transistor 33 is turned on the diode 49 will be, in effect, connected to circuit ground which discharges and disables the starting circuit 9.

In summary, a ballast circuit for fluorescent lamps has been provided wherein the lamps are driven by a substantially symmetrical sine wave potential centered about a substantially zero DC voltage level. Moreover, wave-shaping means are provided for enhancing the symmetry of the drive potential applied to the fluorescent lamp load.

While there has been shown and described what are at present considered the preferred embodiments of the invention, it will be obvious to those skilled in the art that various changes and modifications may be made therein without departing from the invention as defined by the appended claims.

I claim:

1. A single power transistor oscillator circuit comprising:

oscillator means including a single transistor;

means for developing a DC potential connectable to an AC potential source;

starting circuit means including a series connected resistor and capacitor shunting said means for developing a DC potential and coupled to said transistor of said oscillator means;

starting circuit disablement means coupled to said starting circuit means and to said transistor of said oscillator means for discharging said capacitor of said starting circuit means through said single transistor oscillator means;

inductor means coupling said means for developing a DC potential to said oscillator means and to a load circuit; and first potential shaping means shunting said inductor means coupled to said load circuit for shaping an output potential therefrom to provide a substantially symmetrical AC potential having a zero DC voltage central axis.

2. The single power transistor circuit of claim 1 wherein said inductor means includes an inductor coil and a transformer winding coupling said means for developing a DC potential to said oscillator means.

3. The single power transistor of claim 1 including an excess voltage protection means shunting said transistor of said oscillator means.

4. The single power transistor circuit of claim 1 wherein said inductor means includes a transformer having a first secondary winding coupled to said load circuit, a secondary leakage inductance and said means for shaping said output potential is in the form of a capacitor shunting said first secondary winding and in parallel resonance with said secondary leakage inductance and the inductance of said first secondary winding at a given frequency F1.

5. The single power transistor of claim 4 wherein said inductor means includes a series connected inductor coil and primary winding of a transformer coupling said means for developing a DC potential to said oscillator means and a second potential shaping means shunting said oscillator means and in series-resonance with said inductor coil at a frequency of twice the given frequency F1.

6. The single power transistor of claim 5 wherein said second potential shaping means is in the form of a capacitor.

7. A ballast circuit for fluorescent lamps comprising:

a single transistor oscillator means;

rectifier means connectable to an AC potential source;

starting circuit means including a series connected resistor and capacitor shunting said rectifier means and a bi-directionally conductive device connecting the junction of said series-connected resistor and capacitor to the single transistor oscillator means;

starting circuit disablement means including a diode coupling said junction of said starting circuit means to said single transistor oscillator means for discharging said capacitor of said starting circuit means through said single transistor oscillator means;

inductor means including an inductor coil and transformer primary winding series connecting said rectifier means to said oscillator means, a first secondary winding coupled to a load circuit and a second secondary winding providing drive to said single transistor oscillator means; and first potential shaping means shunting said first secondary winding and providing a substantially zero DC centered symmetrical AC potential to said load circuit.

8. The ballast circuit of claim 7 wherein said first secondary winding has a leakage inductance and said first potential shaping means is in parallel resonance with said leakage inductance and first secondary winding inductance at a given frequency F1.

9. The ballast circuit of claim 7 including a second potential shaping means shunting said single transistor oscillator means.

10. The ballast circuit of claim 9 wherein said second potential shaping means is in the form of a capacitor.

11. The ballast circuit of claim 7 including a voltage protection means shunting said single transistor oscillator means.

12. The ballast circuit of claim 11 wherein said voltage protection means is in the form of a diode.

13. The ballast circuit of claim 10 wherein said capacitor of said second potential shaping means is in series resonance with said inductor coil of said inductor means at a frequency of about twice the given frequency F1.

* * * * *